United States Patent [19]

Senba

[11] Patent Number: 4,932,106

[45] Date of Patent: Jun. 12, 1990

[54] WEFT STRAIGHTENER

[75] Inventor: Shoji Senba, Osaka, Japan

[73] Assignee: Tsuchiya Machinery Co., Ltd., Japan; a part interest

[21] Appl. No.: 873,110

[22] Filed: Jun. 10, 1986

Related U.S. Application Data

[63] Continuation-in-part of Ser. No. 647,563, Sep. 5, 1984, abandoned.

[30] Foreign Application Priority Data

| | | | |
|---|---|---|---|
| Sep. 5, 1983 | [JP] | Japan | 58-138091[U] |
| Oct. 8, 1983 | [JP] | Japan | 58-156287[U] |
| Apr. 25, 1984 | [JP] | Japan | 59-61575[U] |
| Apr. 25, 1985 | [JP] | Japan | 59-61577[U] |

[51] Int. Cl.[5] ..... D06C 3/00

[52] U.S. Cl. ..... 26/51.3

[58] Field of Search ..... 26/51.3, 51.4, 51.5

*Primary Examiner*—Werner H. Schroeder

*Attorney, Agent, or Firm*—William A. Drucker

[57] ABSTRACT

A pin wheel type weft straightener attached to various machines which are used for dyeing, printing, finishing of natural and synthetic fiber cloths, in which a pair of pin wheels straightens the skewing or the bowing of a travelling cloth while pinning both selvages of the cloth successively and the inclination angle of each pin wheel can be adjusted without changing the pinning starting position.

Each pin wheel is supported by a pin wheel stand which is movable in the widthwise direction of the cloth by the driving force of a motor or other actuators carried thereon.

Each pin wheel is urged in the divergent direction by a spring mechanism and the inclination angle is reduced when the cloth on each pin wheel is over-tensioned, and also the inclination angle is automatically reduced when the cloth on each pin wheel is interrupted travelling. They can mitigate an abnormal tension of the cloth and prevent the distortion, rupture or breakage of the cloth by automatically reducing the inclination angle to lessen the stretching of the cloth.

In order to obtain a sufficient overfed state preferable for the weft straightening, the travelling cloth is pushed by brush rolls, particularly brush rolls the peripheries of the section of which form the configuration of continuous waves, while pinned with a group of pins on the outer peripheral part of the pin wheels.

10 Claims, 3 Drawing Sheets

WEFT STRAIGHTENER

CROSS-REFERENCE TO PRIOR APPLICATION

This application is a continuation-in-part of application Ser. No. 647,563, filed Sept. 5, 1984, now abandoned.

BACKGROUND OF THE INVENTION

1. Field of the Invention

This invention relates to a weft straightener attached to various machines which are used for dyeing, printing and finishing of natural and synthetic fiber cloths. Particularly, this invention relates to a pin wheel type weft straightener which is attached to various machines for use in dyeing, printing and finishing of natural and synthetic fiber cloths and which straightens the skewing or the bowing of a travelling cloth.

2. Description of the Prior Art

As a weft straightener using pin wheels, the weft straightener disclosed in Japanese Utility Model Publication No. 015056/1980 has been already known. In this straightener, a pair of pin wheels are provided along both selvages divergently and in a weft direction, and a group of pins are projectingly implanted in the outer peripheral parts of these pin wheels. The skewing or the bowing of the cloth is straightened by subsequent pinning of both selvages of the cloth and by the difference of rotation speed of both pin wheels, namely by the difference in the rate of over feed of the cloth.

In Japanese Utility Model Publication No. 004700/1983, an improved weft straightener is disclosed. In this straightener are provided a pair of pin wheels for pinning both selvages of a travelling cloth with a group of pins projectingly implanted on the outher peripheral parts of the pin wheels; a pair of pin wheel stands which support the pin wheels inclinably in relation to the tangent or the neighborhood of the pinning starting position, and which are movable in the weft direction; an inclination controlling means which adjusts the inclination angle of each pin wheel to a desired divergent angle; and position controlling means which adjust each pin wheel stand to a desired position.

In this improved weft straightener, control of an inclination controlling means which adjusts the inclination angle of each pin wheel to a desired divergent angle; and position controlling means which adjust each pin wheel stand to a desired position.

In this improved weft straightener, control of an inclination angle keeps the rockable central axial line straight, and scarcely changes the pinning starting position on the outer peripheral part of the pin wheels, which dispenses with the needs for adjustment of cloth racking when the inclination angle of each pin wheel is adjusted, or adjustment of the location of a brush roll or other attachments. In addition, this type of straightener, wherein each pin wheel stand is locked to each feed screw shaft, and which is disposed across the weft independently of other pin wheel stands, and in which each pin wheel is moved to a desired position in the weft direction by a forward or backward turn of the feed screw shafts, enables, to a certain degree, the control of the intervals between both pin wheels in accordance with the width of a cloth, and also enables automatic follow up of the pin wheels to the selvages of a running cloth.

However, the convention pin wheel type weft straighteners, including the one disclosed in Japanese Utility Model Publication No. 04700/1983, had the problem that they induced deformation or rupture of a travelling cloth under abnormal tension in the weft direction while being pinned by each pin wheel.

Furthermore, in the conventional weft straightener, when movement of the travelling cloth on the pin wheels is stopped while the cloth is being pinned, the cloth on the pin wheels is stretched. If the intervening period is prolonged, deformation or rupture of the cloth is unavoidable, which leads to deterioration in quality and the production of inferior articles.

SUMMARY OF THE INVENTION

Accordingly, it is an object to provide a pin wheel type weft straightener which prevents deformation and rupture of cloth under abnormal tension in the weft direction while a travelling cloth is pinned to the pin wheels, and contributes to an improvement in quality and an increase in productivity.

It is another object to provide a pin wheel type weft straightener which lessens the stretching of a travelling cloth on pin wheels when the cloth on the pin wheels is stopped while the cloth is pinned, and prevents deformation and rupture of cloth as well as contributing to an improvement in quality and an increase in productivity. These and other objects as well as advantages of the present invention will become clear from the following description of a preferred embodiment of the present invention and from the claims.

DESCRIPTION OF THE PREFERRED EMBODIMENT

According to this invention, there is provided a weft straightener which comprises a pair of pin wheels divergently disposed in the weft direction and independently free to rotate, for pinning both selvages of a travelling cloth with a group of pins projectingly implanted on the outer peripheral part of each pin wheel, a pair of pin wheel stands movably disposed in the weft direction, for supporting each pin wheel inclinably in relation to a tangent extending from, or in the vicinity of, the pinning starting position on the circumference of each pin wheel, inclination controlling means for adjusting the inclination angle of each pin wheel to a desired divergent angle, and position controlling means for adjusting each pin wheel stand to a desired position in the weft direction, characterized in that there is provided a spring mechanism for urging each pin wheel in the divergent direction in such a manner that each pin wheel can be inclined in the convergent direction by the travelling cloth being over-tensioned in the weft direction. The invention counteracts any abnormal tension in the weft direction while the travelling cloth is pinned by the pin wheels, that is, the inclination angle of the pin wheel can be reduced when the cloth is over-tensioned in the weft direction because the pin wheels are convergently inclined against the spring mechanism by the pinned cloth being over-tensioned in the weft direction and it can prevent deformation and rupture of cloth as well as contributing to an improvement in quality and an increase in productivity.

Further, the above weft straightener may have a structure in which there are provided interruption detecting means for detecting the interruption of the travel of the cloth on each pin wheel and inclination reducing means for actuating the inclination controlling meansso as to reduce the inclination angle of each pin wheel, on the basis of the output signal of the interruption detecting means. This prevents the generation of abnormal tension in the weft direction and when the cloth on the pin wheels stops travelling while pinned by the pin wheels, the stretching of the cloth is quickly mitigated, preventing deformation and rupture of the cloth and contributing to an improvement in quality and an increase in productivity. The principle of this weft straightening is that when both selvages of the travelling cloth having skewed or bowed wefts are fixed by the pins on the pin wheels and the cloth turns with the pin wheels, a widthwise tension gradually increases on the cloth because of the pin wheels being divergent and the stretched wefts obliquely spanning the two pin wheels will naturally act to take the shortest length between the two pin wheels and, thus, to differentially rotate each pin wheel to the position where the wefts take the shortest length, namely to the position where the wefts become straightened at right angles to warps.

In this invention, the means by which the pin wheel stand is supported and the inclination control means of a pin wheel are not specifically restricted. For example, the structure can be adopted, in which each pin wheel is rotatably connected to a varied-angle shaft on the tangent extending from, or in the vicinity of, the pinning starting position on the circumference of the pin wheel, each varied-angle shaft is rotatably supported by the pin wheel stand, a worm wheel is attached to each varied-angle shaft, each worm wheel is meshed with a worm, each worm is axially-slidably and interlockingly-rotatably mounted on a worm shaft and is axially urged by a spring mechanism in such a manner that each pin wheel can be urged in the divergent direction, the worm shaft is disposed across the cloth width, and the inclination angle of each pin wheel is adjusted to desired divergent degrees by controlling the rotation angle of the worm shaft. In this invention, when the worm shaft is rotated by desired degrees, the worm, the worm wheel and the varied-angle shaft are rotated successively, and the pin wheel rocks about the pinning starting position and forms a desired inclination angle.

Position controlling means for each pin wheel stand of this invention may have a structure, for example in which each pin wheel stand can be adjusted to the cloth width by the driving force of an actuator mounted on the wheel stand.

The structure as described above, in which each pin wheel stand is adjusted to the widthwise length of the cloth by the driving force of the actuator carried in the pin wheel stand, is superior in various points to the structure in which the pin wheel stand is engaged with a screw shaft arranged across the weft, and is fed in the widthwise direction of the cloth by the turn of the screw. For example, the apparatus can be miniaturized; the selection of the centering position of the travelling cloth in the widthwise direction of the cloth and the adjustment of the intervals of both pin wheels can be freely conducted; the adaptability to the width of the cloth is superior; and the weft straightening of more than two cloths very different in width can be executed with this weft straightener alone.

In this invention, when the widthwise tension of the cloth on the pin wheels is low, the spring system is not activated nor does it change its position, which maintains the inclination angle of the pin wheels at a predetermined angle, but when the tension of the cloth exceeds a predetermined value, the spring system is actuated or changes its position, which reduces the inclination angle of the pin wheels and mitigates the stretching of the cloth in the weft direction. The spring mechanism is preferably adjustable in resilience depending on the type of cloth and other factors.

The automatic reducing mechanisms for adjustment of the inclination angle of each pin wheel when the cloth is over-tensioned and for adjustment of the inclination angle of each pin wheel when the cloth movement is interrupted should be properly selected in accordance with the structure and type of a particular pin wheel and is not specified in this invention. The adjustment of the inclination angle of each pin wheel can be made by manually or automatically driving an inclination angle control motor which actuates the inclination controlling means, while detecting the inclination angle of each pin wheel. In the structure wherein the worm wheel and worm are intermeshed, each pin wheel may be inclined in the opposite direction by an equal angle of adjustment by a forward or backward rotation of the worm shaft in such a manner that each pin wheel can be constantly symmetrically inclined about the center line of a travelling cloth.

The automatic reducing mechanism of the inclination angle of each pin wheel may have a structure in which a dancer roll rocking in accordance with the lengthwise tension of the travelling cloth is also used for the interruption detecting means, a limit switch actuated by the rocking motion of the dancer roll feeds an interruption signal to the inclination reducing means, and the inclination controlling means actuated by the inclination reducing means incline each pin wheel in the convergent direction.

Furthermore, in this invention, it is important for effective weft straightening that the cloth should be pinned in a sufficiently overfed state. To this end, brush rolls are arranged across the weft so that they may engage with the group of pins projectingly implanted on the outer peripheral part of the pin wheels at the pinning starting position, and both selvages of the cloth are pinned with the group of pins while being pushed with the brush rolls.

DETAILED DESCRIPTION OF THE INVENTION

Figure 1:
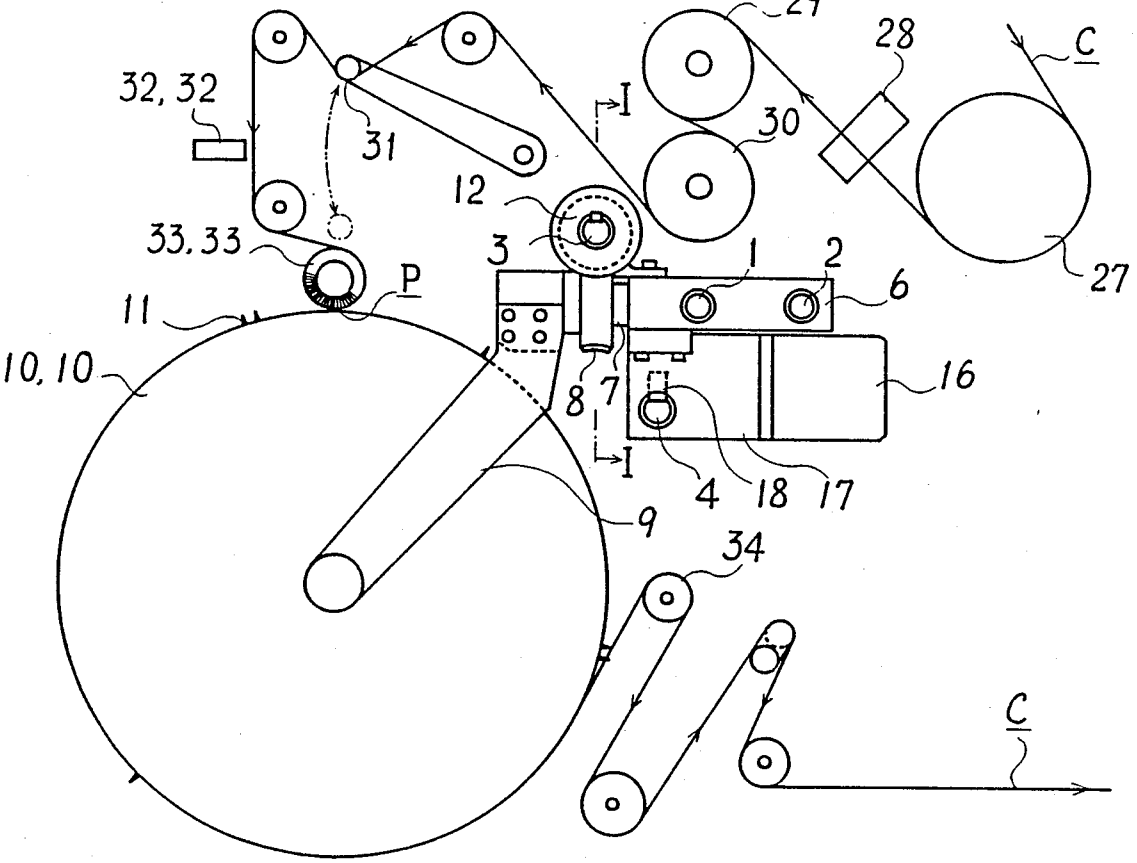
FIG. 1 is a side view of the main part of a preferred weft straightener according to this invention.
Figure 2:
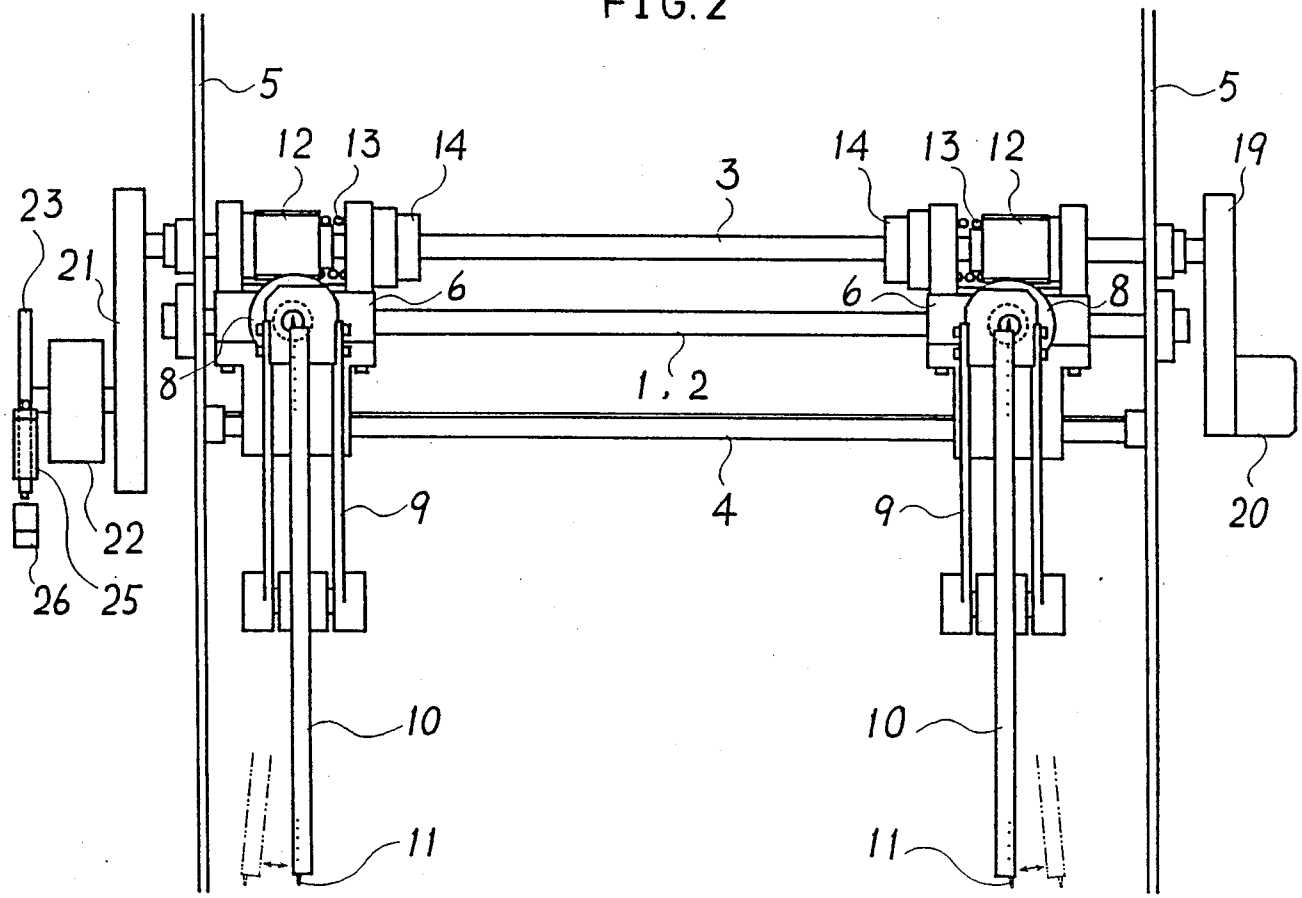
FIG. 2 is a front view of the main part of a pin wheel operation mechanism of the weft straightener shown in FIG. 1.
Figure 3:
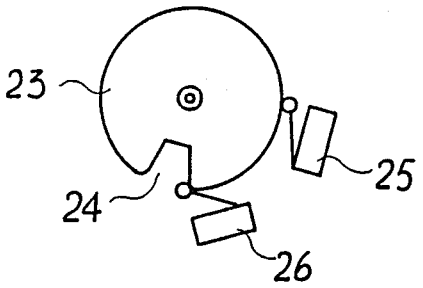
FIG. 3 is a side view of the main part of a cam board in the pin wheel operation mechanism shown in FIG. 2.
Figure 4:
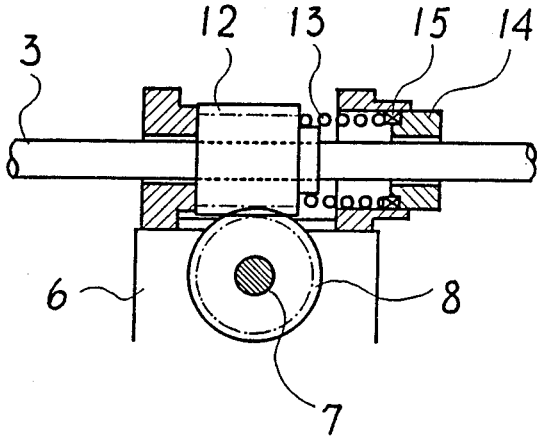
FIG. 4 is a sectional view of the weft straightener taken along the line I—I of FIG. 1.

In order to make the invention clearer, hereinunder it will be described in detail with reference to the attached drawings.

Referring first to FIGS. 1 to 4, the pin wheel mechanism will be explained. Two guide shafts 1, 2 are disposed across the weft and a worm shaft 3 and a rack 4 are disposed linking frames 5, 5 in parallel with the guide shafts 1, 2. Into the two guide shafts 1, 2, a pair of pin wheel stands 6, 6 having the same mechanism are slidably inserted. Since these pin wheel stands 6, 6 each have the same pin wheel mechanism, hereinunder a pin wheel mechanism of a single pin wheel stand 6 only will be explained. In the pin wheel stand 6, a varied-angle shaft 7 is rotatably supported perpendicular or substantially vertically in relation to the weft. In the middle part of the varied-angle shaft 7, a worm wheel 8 is attached coaxially, and on the end portion of the varied-angle shaft 7 a forked arm 9 is attached extending obliquely downwardly. On the arm 9, a pin wheel 10 is divergently and rotatably mounted in such a way that an extended axial line of the varied-angle shaft 7 forms, or is in the vicinity of a tangent to the pin wheel at the pinning starting position P on the circumference of the pin wheel. On the outer peripheral part of the pin wheel 10 a plurality of pins 11 are projectingly implanted at a desired pitch.

On the pin wheel stand 6, a worm 12 is rotatably carried in the widthwise direction of the cloth through a compressing coiled spring 13 whch is arranged in series in the inside end of the worm 12, in the state of intermeshing with the worm wheel 8, and is inserted into the worm shaft 3 slidably and rotatably interlocking with it in such a conventional manner that bosses on the inside hole of the worm 12 can be slidably engaged with splined channels on the worm shaft 3. On the pin wheel stand 6, the worm shaft 3 is movably inserted into an adjust bolt 14, in such a manner that the adjust bolt 14 will press the inside end of the compressing coiled spring 13 through a bearing 15.

Further, on the pin wheel stand 6 are carried a position control motor 16, its speed regulator 17, a selvage sensor (shown later as 32) the output signal of which is fed to the control circuit (not shown) of the position control motor 16 for automatic follow up of the pin wheel 10 to the selvage of the cloth C and a pinion 18 which is rotated by the position control motor 16 and the pinion 18 is engaged with the rack 4. The position control motor 16 can be manually driven in a conventional manner for moving the pin wheel stand 6 along the guide shafts 1, 2 to a desired position in the weft direction and also automatically driven in a conventional manner for moving the pin wheel stand 6 along the guide shafts 1, 2 to the selvage of the cloth C which is apt to be laterally shifted so that the pin wheel 10 can automatically follow up the selvage of the cloth C.

The worm shaft 3 is connected at one end to the inclination angle control motor 20 through a gear 19 and at the other end is connected to one end of the rotary shaft of a detection potentiometer 22 through a speed regulator 21, while on the other end of the rotary shaft of the direction potentiometer 22 is mounted a cam board 23. The detection potentiometer 22 which may have a conventional structure of a variable resistor, detects the rotation angle of the worm shaft 3 and outputs the voltage corresponding to the inclination angle of the pin wheel 10, and is connected in parallel to an angle set potentiometer (not shown) which may also have a conventional structure of a variable resistor and which outputs the voltage corresponding to a desired inclination angle of the pin wheel 10.

The above parallel circuit which outputs the voltage deviation between the two potentiometers and which is generally known as a conventional circuit for a servo system, is connected to the control circuit (not shown) of the inclination angle control motor 20. A notch 24 is cut out of the cam board 23, in the vicinity of which, at the portion of the upper limit 60 degrees of the inclination angle (divergent angle 120 degrees) and the lower limit 0 degrees of the inclination angle (divergent angle 0 degrees) an upper limit switch 25 and a lower limit switch 26, respectively, are disposed and they are connected to the control circuit (not shown) of the inclination angle control motor 20. The notch 24 indirectly denotes the inclination angle of the pin wheel. The limit switch (not shown) which is actuated by the rocking motion of a dancer roll (shown later as 31) and detects the interruption of the travelling of the cloth C on the pin wheel 10 is mounted at a proper position and is connected to the control circuit of the inclination angle control motor 20.

In the structure above mentioned, by controlling the rotation angle of the worm shaft 3 adjustment of the degree of stretching the cloth, namely adjustment of the inclination angle of the pin wheel, can be achieved. The rotation of the inclination angle control motor 20 is transmitted to the gear 19, the worm shaft 3, the worm 12, the worm wheel 8 and the varied-angle shaft 7, which rocks the arm 9, and thus the pin wheel 10, and inclines the pin wheels 10, 10 on both sides in the opposite direction and by an equal angle of adjustment. On the other hand, the rotation of the worm shaft 3 rotates the speed regulator 21, the rotary shaft of the detection potentiometer 22 and the cam board 23, and when the inclination angle of the pin wheel reaches the divergent angle 120 degrees or 0 degrees, the notch 24 of the cam board 23 activates the upper limit switch 25 or the lower limit switch 26, respectively, thus immediately stopping the inclination angle control motor 20. The inclination angle control motor 20 can be driven in a forward or backward direction for adjusting of the inclination angle of the pin wheel 10 to predetermined degrees, manually in a conventional manner on the basis of that indication of the output of the detection potentiometer 22 which shows the inclination angle of the pin wheel 10, or also automatically in a conventional manner on the basis of the output deviation between the detection potentiometer 22 and the angle set potentiometer so that the output deviation may be reduced to zero.

When the travel of the cloth C is stopped while pinned by the pin wheel 10, the dancer roll rocks to the limit and the limit switch for detecting interruption described above starts the inclination angle control motor 20 in the direction of reducing the inclination angle of the pin wheel, and subsequently the lower limit switch 26 is actuated as described above to stop the motor 20 at the position where the inclination angle of the pin wheel is the divergent angle 0 degrees.

When the cloth C is subject to abnormal tension in the weft direction while being pinned by the pin wheel 10, the pin wheel 10 is convergently stressed, the worm wheel 8 is rotated, the worm 12 is axially shifted along the worm shaft 3 and the compressing coiled spring 13 is compressed successively, and thus the inclination angle of the pin wheel 10 is reduced so that the cloth C is prevented from rupture and breakage. In the above case, with the rotation of the worm wheel 8, the worm 12 is not rotated with the worm shaft 3 but axially shifted along the worm shaft 3 because the worm shaft 3 slidably engaged with the worm 12 cannot be freely rotated. The resilience of the compressing coiled spring 13 can be adjusted by the turn of an adjust bolt 14 in accordance with the permissible tension of the cloth C and other factors.

When the position control motor 16 carried on the pin wheel stand 6 starts, the pinion 18 is rotated through the speed regulator 17 and moves straight on the rack 4 in the engaged state, and thus, the pin wheel stand 6 itself moves straight on the rack 4. Therefore, each pin wheel 10 is freely movable in the widthwise direction of the cloth, by control of the position control motor 16, and it is thus made easily possible to introduce the system of the adjustment of the interval of the pin wheels 10, 10, the selection of the central position of the travelling cloth C and automatic follow up of the pin wheel 10 to the selvage of the cloth C, where the pin wheel stand 6 is moved in the weft direction along the guide shafts 1, 2 to a desired position in a conventional manner by the automatic control of the position control motor 16.

Next, the whole structure of the weft straightener having the above pin wheel mechanism will be explained. In FIG. 1, the cloth C is fed to, for example, an endless belt (not shown) of an auto-screen printing machine successively through a centering roll 27 which may have a conventional structure of a roll cloth guider or a slat cloth guider, the roll cloth guider having guide rolls inclinably and rotatably disposed in the weft direction, the slat cloth guider having many slats axially-slidably mounted in parallel in the weft direction on the surface of a cylinder which is rotated, a selvage sensor 28, feed rolls 29, 30, a dancer roll 31, selvage sensors 32, 32, brush rolls 33, 33, pin wheels 10, 10, a bar expander 34 and so on.

Figure 5:
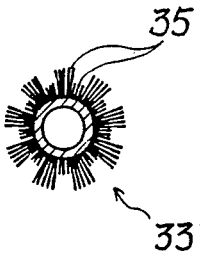
FIGS. 5 and 6 are sectional views vertical to the axial line of preferred brush rolls which can be used for this invention.
Figure 6:
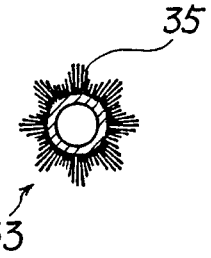

The centering roll 27 automatically amends the travelling of the cloth C so as to pass the cloth C along the widthwise center of the inlet of the weft straightener, contributing to effective weft straightening. The selvage sensor 28 detects the selvage of the cloth C in the weft direction and feeds its output signal to the control circuit (not shown) of the centering roll 27 for the automatic amendment of the travelling of the cloth C. The feed rolls 29, 30 feed the cloth C by a motor (not shown), and the dancer roll 31 feeds the cloth C to pin wheels 10, 10, with a constantly low tension while rocking in accordance with the difference between the feeding amount of the cloth C supplied by the feed rolls 29, 30, and the drawing amount of the cloth C produced by the endless belt (not shown) above mentioned. The dancer roll 31 is also used for detecting the interruption of the travel of the cloth C. The brush rolls 33, 33 push the cloth C on the outer peripheral part of the pin wheels 10, 10 in the overfed state, and the pin wheels 10, 10 automtically follow the selvages of the cloth C, pin the pushed cloth C in the overfed state and straighten the weft. The selvage sensors 32, 32 detect the selvages of the cloth C for the automatic follow up. For the feeding of the stretched cloth C to the following endless belt (not shown), the bar expander 34 stretches the cloth C after weft straightening. The brush rolls 33, 33 may be made of a short and long brush 35 in such a manner that the periphery of their section may have the configuration of continuous square waves, as is shown in FIG. 5, or continuous sine waves or triangle waves, as is shown in FIG. 6. The brush rolls 33, 33 have the cloth c supplied in a regular and stable overfed state and with a sufficient maount of overfeed because the group of pins 11 pin the cloth C while the rotating brush rolls 33, 33 push the cloth C into the movable group of pins 11 substantially in the configuration of continuous waves corresponding to a wave-patterned surface of the brush rolls 33, 33. In addition, these wave-patterned brush rolls 33, 33 contribute to mitigating any skewing or bowing of the cloth C by relatively slowing the speed of trhe wefts travelling forward, because the brush roll 33 has its diameter partially reduced by contacting that portion of the cloth C in whcih the wefts are travelling forward, namely to which the tension applied is larger and the circumferential speed of the brush roll 33 is partially lowered.

I claim:

1. A weft straightener comprising a pair of pin wheels having a group of pins projectingly implanted on the outer peripheral part of each pin wheel divergently disposed in the weft direction and independently free to rotate, for pinning both selvages of a travelling cloth with said group of pins projectingly implanted on the outer peripheral part of each pin wheel, guide shafts, a varied angled shaft, a pair of pin wheel stands movably disposed along said guide shafts in the weft direction, supporting each pin wheel through said varied-angle shaft connected thereto, inclinably in relation to a tangent extending substantially from, the pinning starting position on the circumference of each pin wheel, inclination controlling means for adjusting the inclination angle of each pin wheel to a desired divergent angle, and position controlling means for adjusting each pin wheel stand to a desired position in the weft direction, further including a spring mechanism between each pin wheel and pin wheel stand for urging each pin wheel in the divergent direction, each pin wheel being inclined in the convergent direction responsive to the travelling cloth being over-tensioned in the weft direction.

2. A weft straightener according to claim 1 further including an actuator carried on the pin wheel stand wherein said position controlling means has a structure that each pin wheel stand is adjusted in the widthwise direction of the cloth by the driving force of said actuator.

3. A weft straightener according to claim 1 further including a rack, said position controlling means having a structure that a motor is carried on each pin wheel stand and a pinion rotated by the motor and engaged with said rack, said rack being arranged in the widthwise direction of the cloth.

4. A weft straightener according to claim 1 further including brush rolls arranged across the cloth width to engage with the group of pins, for pushing both selvages of the travelling cloth into the group of pins.

5. A weft straightener according to claim 4 wherein the brush rolls are composed of a short and a long brush in such a manner that the periphery of their section which is vertical to the axial line has the configuration of continuous waves.

6. A weft straightener comprising a pair of pin wheels having a group of pins projectingly implanted on the outer peripheral part of each pin wheel divergently disposed in the weft direction and independently free to rotate, for pinning both selvages of a travelling cloth with said group of pins projectingly implanted on the outer peripheral part of each pin wheel, guide shafts, a varied angle shaft, a pair of pin wheel stands movably disposed along said guide shafts in the weft direction for supporting each pin wheel through said varied-angle shaft connected thereto, inclinably in relation to a tangent extending substantially from, the pinning starting position on the circumference of each pin wheel, inclination controlling means for adjusting the inclination angle of each pin wheel to a desired divergent angle, and position controlling means for adjusting each pin wheel stand to a desired position in the weft direction, further including a spring mechanism between each pin wheel and pin wheel stand for urging each pin wheel in the divergent direction, each pin wheel being inclined in the convergent direction by the travelling cloth being overtensioned in the weft direction, and also in that there are provided interruption detecting means for detecting the interruption of the travel of the cloth on each pin wheel and inclination reducing means for actuating the inclination controlling means to reduce the inclination angle of each pin wheel responsive to the output signal of the interruption detecting means.

7. A weft straightener according to claim 6 wherein said position controlling means has a structure that each pin wheel stand is adjusted in the widthwise direction of the cloth by the driving force of an actuator carried on the pin wheel stand.

8. A weft straightener according to claim 6 further including a rack, wherein said position controlling means includes a motor carried on each pin wheel stand and a pinion rotated by the motor and engaged with said rack which is arranged in the widthwise direction of the cloth.

9. A weft straightener according to claim 6 further including brush rolls arranged across the cloth width to engage with the group of pins, for pushing both selvages of the travelling cloth into the group of pins.

10. A weft straightener according to claim 9 wherein the brush rolls are composed of a short and a long brush in such a manner that the periphery of their section which is vertical to the axial line has the configuration of continuous waves.

* * * * *